United States Patent [19]

Wirth

[11] Patent Number: 4,493,446

[45] Date of Patent: Jan. 15, 1985

[54] MULTIPLE ROLL TAPE DISPENSER

[75] Inventor: Gary J. Wirth, Milwaukee, Wis.

[73] Assignee: W. H. Brady Co., Milwaukee, Wis.

[21] Appl. No.: 519,282

[22] Filed: Aug. 1, 1983

[51] Int. Cl.[3] ..... B26D 1/02

[52] U.S. Cl. ..... 225/21; 225/26; 225/34; 225/38; 225/78; 225/90

[58] Field of Search ..... 225/15, 19, 20, 21, 225/25, 26, 34, 36, 37, 38, 45, 78, 53, 90; 242/55.42, 55.54, 55.3, 55.53

[56] References Cited

U.S. PATENT DOCUMENTS

| | | | |
|---|---|---|---|
| 757,844 | 4/1904 | Scott | 225/51 |
| 3,521,800 | 7/1970 | Stephens et al. | 225/21 |
| 3,552,616 | 1/1971 | Mason | 225/38 |
| 4,252,258 | 2/1981 | Plummer | 225/25 |
| 4,262,835 | 4/1981 | Wrobel | 225/25 |

*Primary Examiner*—Frank T. Yost
*Assistant Examiner*—Hien H. Phan
*Attorney, Agent, or Firm*—Quarles & Brady

[57] ABSTRACT

A tape dispenser (1) for a plurality of rolls of pressure sensitive adhesive tape (70) including a tape storage compartment (5) and tape severance compartment (6) in which are located flexible retention wings (40), guard fingers (17) and tape cutter bar (50). Tape is drawn across a flexible retention wing and the cutter bar for severance, following which it is retained on a flexible retention wing and has a free end portion (70*a*) that can be grasped for subsequent severance of another length of tape.

8 Claims, 7 Drawing Figures

MULTIPLE ROLL TAPE DISPENSER

TECHNICAL FIELD

This invention relates to a dispenser for storing a number of rolls of pressure sensitive adhesive tape which is also adapted to enable dispensing of a selected portion of tape from any roll stored in the dispenser.

BACKGROUND ART

Pressure sensitive adhesive tapes bearing alphanumeric data are often used for industrial purposes to identify various objects such as electrical wires, pipe conduits, etc. This usage may require having available a number of rolls of tape, each bearing different identification data, such as a group of tapes having a printed series of sequential numbers or letters, in order that specific elements can each bear an individual identification marker. One example of this type of use is the marking of electrical wires with wiremarkers consisting of a strip of tape formed of a layer of plastic or cloth printed on one surface with sequential numerical data and bearing a layer of pressure sensitive adhesive on an opposite surface.

A worker may have to carry a set of rolls of tapes of this type which are preprinted with serial identification numbers, for example, 10 rolls of tape each bearing numbers 1 through 10. There has thus developed a demand in the marketplace for a tape dispenser that can hold a number of rolls of tape and which will allow a worker to withdraw a piece from any selected roll in order to identify a particular element. A multiple roll tape dispenser must provide for storing a number of rolls of tape and include cutting means for severing a selected portion from any roll of tape.

Minnesota Mining and Manufacturing Company presently markets a multiple roll tape dispenser constructed in accordance with its U.S. Pat. No. 4,262,835. In the 3m device, the rolls of tape are each supported vertically on a separate core and carried in an individual housing in a gang-type cylindrical dispenser. The rolls of tape are arranged so that their adhesive side will adhere to an arcuate door which is hinged over each tape compartment; opening of the arcuate door will withdraw a small portion of each roll of the tape which forms a tab a user can grasp and pull across a cutting edge in order to cut off the selected length of tape. Another style of multiple roll tape dispenser is described in U.S. Pat. No. 4,252,258 and comprises a main housing divided into side-by-side cells, each to store a single roll of tape, a front wall having a series of ports through which each tape is led, and an L-shaped portion extending from the housing and including a cutting means for severing the tape and holding the free end of each tape after it has been cut.

It is my belief that the foregoing prior art tape dispensers adapted for handling a number of rolls of tape have structural and functional limitations which are disadvantageous. Both dispensers are bulky items because of the manner in which the rolls of tape are supported vertically in the dispensers. Also, the dispenser disclosed in U.S. Pat. No. 4,252,258 is not structured so as to form a free end of the tape after severance which can be readily grasped by a user to facilitate the subsequent dispensing of tape. The dispenser of U.S. Pat. No. 4,262,835 provides an upstanding free end of tape which the user can grasp, but it is felt that the action by which the free end is developed with the dispenser requires a high degree of manipulation by the user, especially when it is desired to dispense several pieces of tape or several different tapes, thereby creating an inconvenient situation. Also, the dispenser is inconvenient with respect to allowing a user to quickly select a specific tape from the rolls of tapes housed in the dispenser. The multiple roll tape dispenser of my present invention was developed in order to overcome these and other deficiencies of the prior art multiple roll tape dispenser of which I am aware.

DISCLOSURE OF INVENTION

The multiple roll tape dispenser of the present invention comprises a closed housing in which a number of rolls of tape are stored in a horizontal position. The tape from each roll is led across a wall of the dispenser with its adhesive layer in contact with a flexible retention wing that extends from the wall. A cutting means is attached to the dispenser and spaced from the retention wings. The dispenser includes two hinged covers, a first cover which can be opened to allow easy replacement of the rolls of tape, and a second cover which is hinged to an open position when it is desired to dispense a piece of tape from any selected roll. When the user desires to dispense a length of tape from a selected roll, the second cover is hinged open, the appropriate tape is selected, a suitable length is withdrawn and then moved downwardly over the flexible retention wing against the cutting means to sever the length of tape, following which the flexible retention wing pulls the tape off the cutting means. Due to the spacing of the cutting means and the retention wings, an unsupported free end of the tape is provided to enable convenient dispensing of the next length of tape when desired. Further, the new dispenser of this invention provides for protective guarding of the cutting means to reduce the chances of injury to a user.

One of the objectives of the present invention was to provide a multiple roll tape dispenser which can be made in a flat structure so as to be convenient to be carried in a worker's shirt pocket or pant pocket. Another was to provide a multiple roll tape dispenser incorporating a cutting means and tape retention structure so arranged that there would be a free end of tape available for grasping for the next dispensing after a piece of tape has been severed from a roll. Another objective was to provide a multiple roll tape dispenser in which a user can readily see all of the rolls of tape carried in the dispenser to thereby facilitate selection of the desired tape and replacement of rolls when necessary. Another main object was to provide a multiple roll tape dispenser incorporating cutting means in which the cutting means is guarded to minimize injury to a user. Other more specific objects of this invention will become apparent from the ensuing description.

DESCRIPTION OF THE DRAWINGS

The invention is fully disclosed hereinafter, in accordance with the requirements of Sec. 112, by reference to the following drawings in which.

BEST MODES FOR CARRYING OUT THE INVENTION

(a) Structural Description

FIGS. 1–7 illustrate a multiple roll tape dispenser 1 constructed in accordance with the concepts and principles of the present invention.

Figure 1:
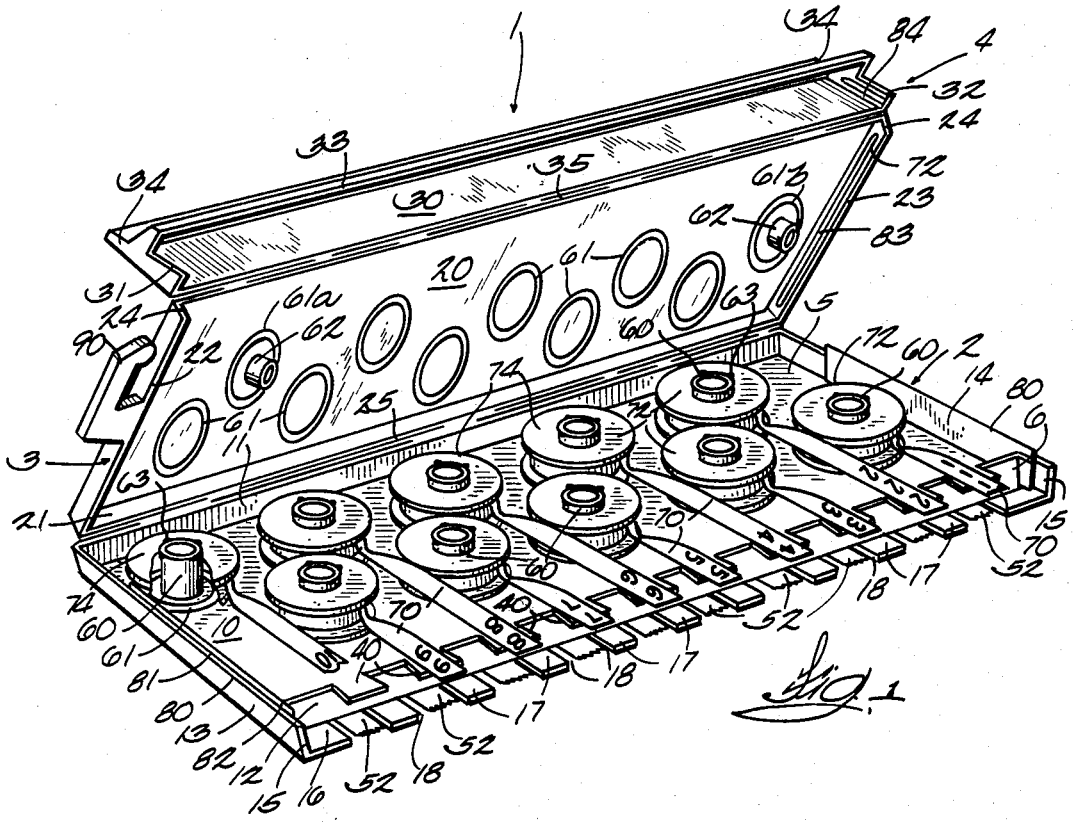
FIG. 1 is a perspective view of a multiple roll tape dispenser of this invention with its cover elements in the open position.

Turning first to FIG. 1, the tape dispenser 1 comprises three principal elements, base member 2, first cover member 3 and second cover member 4. As will be explained in greater detail below, the base member 2 and first cover 3 combine to form a tape storage compartment 5 in which a number of rolls of tape are stored, and the base member 2 and the second cover member 4 combine to form a tape severance compartment 6 in which cutting means and tape retention means are located.

The base member 2 (see also FIG. 2) includes bottom panel 10, rear wall 11 and front wall 12 each extending upwardly from the base panel, and side walls 13 and 14. The front wall 12 is positioned inwardly of the forward ends 15 of the side walls 13 and 14. The portion 16 of the bottom panel 10 which is located forward of the front wall 12 has a plurality of spaced guard fingers 17 separated by slots 18 for the purpose to be described below.

The first cover member 3 comprises a top panel 20, rear wall 21 and opposed side walls 22 and 23. The side walls 22 and 23 of the first cover member 3 are shorter than the side walls 13 and 14 of the base member 2 and their forward ends 24 terminate near the front wall 12 of the base member. The rear wall 21 of the first cover member is connected along continuous hinge 25 to the rear wall 11 of the base member.

The second cover member 4 includes a top panel 30, opposed side walls 31 and 32, and front wall 33 that extends between the side walls. The front wall 33 is positioned inwardly of the forward ends 34 of the side walls 31 and 32 of the second cover member and extends across the forward ends 15 of the side walls 13 and 14 of the base member 2. The top panel 30 of the second cover member is connected to the forward edge of the top panel 20 of the first cover member along continuous hinge 35.

Figure 2:
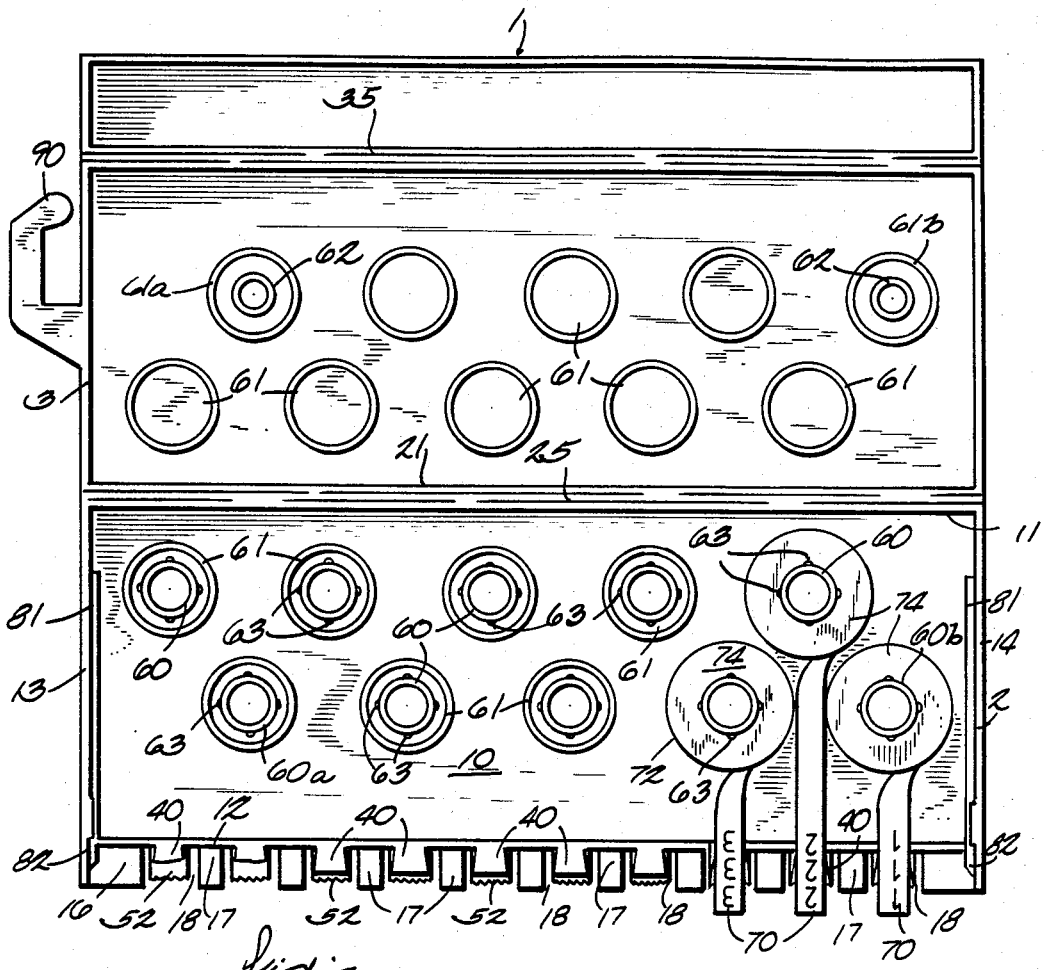
FIG. 2 is a top view of the dispenser of FIG. 1.
Figure 3:
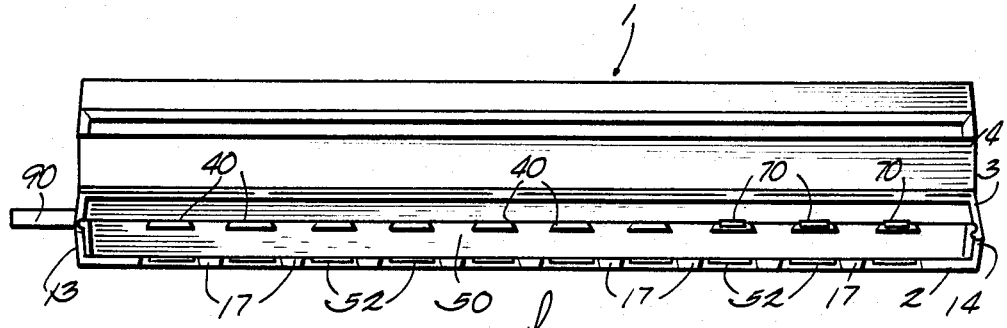
FIG. 3 is a front view of the dispenser of FIG. 1.
Figure 5:
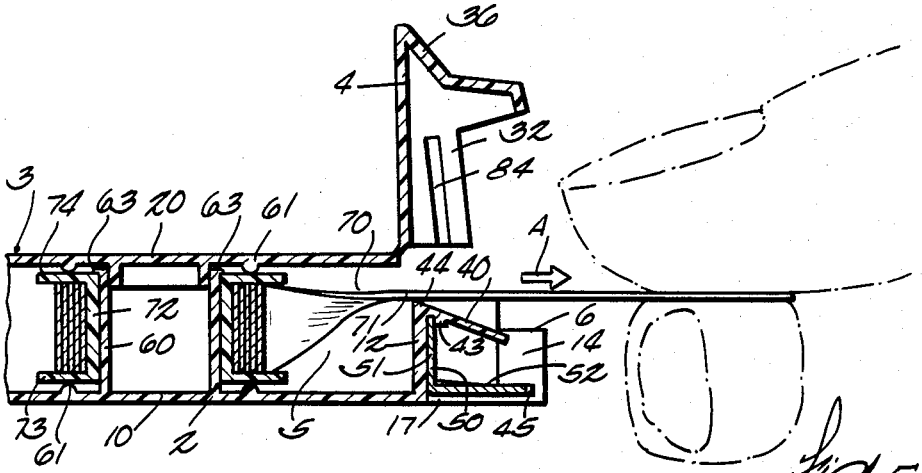
FIG. 5 is a partial sectional view illustrating a first step in the dispensing of tape from a roll in the dispenser.
Figure 6:
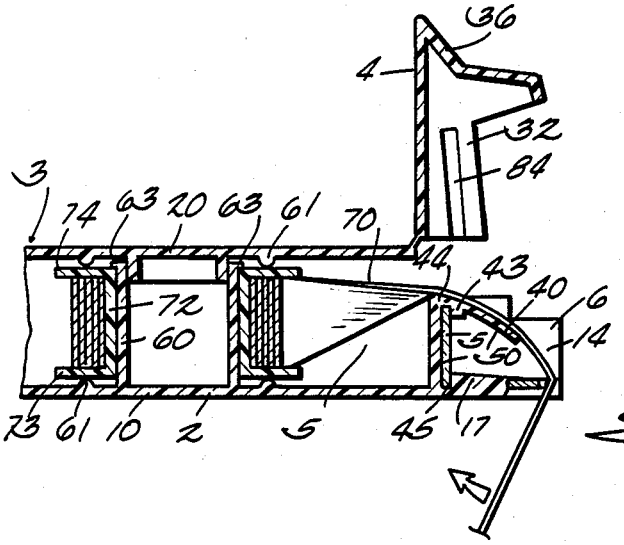
FIG. 6 is a view similar to FIG. 5, but with a portion broken away, showing a second step in the dispensing of tape from the dispenser.
Figure 7:
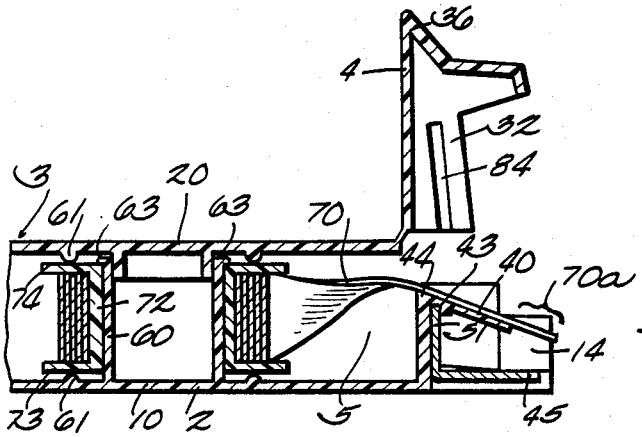
FIG. 7 is a view similar to FIGS. 5 and 6 illustrating a third step in the dispensing of tape from the dispenser.

As shown in FIGS. 1 and 2, a plurality of spaced flexible retention wings 40 extend from the upper edge of the front wall 12 of the base member 2, the function of which will be explained in greater detail below. A retention wing 40 is positioned above each slot 18 of the forward portion 16 of the bottom panel 10 of the base member, and the retention wings are located in the tape severance compartment 6 of the dispenser 1. The cross-sectional configuration of the retention wings 40 is illustrated in FIGS. 5–7. Referring to FIG. 5, each retention wing 40 in the illustrative embodiment extends downwardly from the upper edge of the front wall 12 at an angle of about 20° from the horizontal. The flexible retention wings may extend horizontally from the front wall 12, i.e. perpendicular to the front wall, or at an angle of up to about 30° downwardly from the horizontal. Flexible retention wings are angled downwardly can allow improved visibility of the tape from various sight angles. A short shoulder 43 extends from the underside of each wing 40 near its root portion to define a notch 44 between each shoulder and the front wall 12.

Tape cutting means comprising an L-shaped cutter bar 50 in the illustrative embodiment is secured to the dispenser. The cutter bar 50 has a vertical leg 51 (see FIG. 5) that contacts the forward surface of the front wall 12 of the base member, the upper edge of which is inserted in the notches 44. The lower edge of the vertical leg 51 is inserted into similar retaining notches 45 which are formed across the root portion of each guard finger 17 along the top thereof as shown in FIG. 6. This arrangement serves to attach the cutter bar 50 to the dispenser 1 inside the tape severance compartment 6. A plurality of spaced cutting fingers 52 extend horizontally from the vertical leg of the cutter bar 50. As shown in FIGS. 1 and 2 each cutting finger 52 is located within a slot 18 of the forward portion 16 of the bottom panel 10 of the base member 4 so as to be interdigitated with the guard fingers 17. Further, there is a cutting finger 52 positioned underneath and spaced vertically from each flexible retention wing 40. The outer edge of each cutting finger may be serrated as illustrated in the drawings or have a straight cutting edge. The cutter bar 50 may have other configurations than the illustrated combination of the vertical leg 51 and spaced cutting fingers 52. For example, it may comprise a single horizontal element with spaced cutting fingers; also, it may have a single continuous cutting edge instead of spaced cutting fingers, in which case the continuous cutting edge extends across all of the guard fingers 17 of the tape severance compartment of the dispenser. When a cutter bar 50 with a continuous cutting edge is used, it is preferable that it be attached inside the tape severance compartment 6 so as to maximize protection to a user, but can also be attached to the dispenser outside the tape severance compartment along the leading edge of the portion 16 of the bottom panel 10 underneath the guard fingers 17.

Returning now to FIG. 1, and with reference also to FIG. 2, the storage compartment 5 of the dispenser includes a plurality of vertical hubs 60 which extend upwardly from the bottom panel 10 of the base member. There are ten hubs 60, arranged in two rows of five each in the illustrative embodiment. The base of each hub 60 is surrounded by an annular boss 61 concentric therewith and spaced slightly from the exterior of the hub. The top panel 20 of the first cover member 3 includes a series of similar annular bosses 61 which are positioned to surround the upper end of each hub 60 when the first cover member is closed over the base member. The outer annular bosses 61*a* and 61*b* of the top panel 20 include a short stub shaft 62 concentric therewith and positioned inside the boss. Further, each hub 60 includes a plurality of ears 63 extending therefrom near the upper end of each hub, there being four such ears 63 on hub 60 in the illustrative embodiment, as shown with respect to hub 60*a* in FIG. 2.

Pressure sensitive adhesive tape 70, which may include identification data printed on its upper surface, having a layer of pressure sensitive adhesive 71 along its lower surface is wound into roll form onto a core 72, see FIG. 5. Each core 72 is inserted over a hub 60 so that its lower wall 73 rides on an annular boss 61 extending from the bottom panel 10 of the base member of the dispenser. The ears 63 of a hub 60 extend over the upper wall 74 of the core so as to aid in retaining it in place on a hub 60. The annular bosses 61 extending from the interior surface of the top panel 20 of the first cover member are positioned over the upper wall 74 of each core of a roll of tape 70. The annular bosses 61 on the bottom panel 10 serve to reduce the friction between the lower wall of the core as the roll of tape rotates, and the bosses 61 extending from the top panel perform the same function in event a roll of tape rides slightly upward along a hub 60; also, the bosses 61 aid in centering a roll of tape within the storage compartment 5.

As best illustrated in FIG. 1, each strip of tape 70 is withdrawn from its respective core with its adhesive layer 71 facing downwardly and led over a flexible retention wing 40. The adhesive layer of each tape is lightly adhered to a flexible retention wing so that the tape will be retained thereon and yet be manually releasable from a retention wing when it is desired to dispense a length of tape from a roll.

After rolls of tape 70 have been loaded onto the hubs 60 as described above, the first cover member 3 is folded about hinge 25 over the base member 2 so as to close the tape storage compartment 5 of the dispenser 1. Considering first FIG. 1, the side walls 13 and 14 of the base member have an elongated tongue 80 extending upwardly therefrom that includes a longitudinal flange 81 extending outwardly from its upper edge. A shorter flange 82 also extends outwardly from the upper edge of each tongue 80 and is spaced slightly from the flange 81. A longitudinal groove 83 is formed along the inner surface of side wall 22 and side wall 23 of the first cover member 3, the groove 83 along the side wall 23 being visible in FIG. 1. With the dispenser in the condition illustrated in FIG. 4, in which first cover member 3 is closed over the base member 2, the flanges 81 of the side walls 13 and 14 fit within the longitudinal grooves 83 formed along the side walls 22 and 23 of the first cover member 3. When the flanges 81 are engaged within the grooves 83, the first cover member 3 is locked in a closed position over the base member 2. Also, when the first cover member 3 is in its closed position, the stub shafts 62 fit within two of the hubs 60 of the base member to aid in positioning the cover over the tape storage compartment. The second cover member 4 is locked in a closed position onto the base member 2 in a similar manner. Referring to FIGS. 1 and 5, side walls 31 and 32 of the second cover member include a short longitudinal groove 84. When the second cover member 4 is hinged downwardly about the hinge 35, the flanges 82 of the tongues 80 of the side walls 13 and 14 of the base member engage the grooves 84 to retain the second cover member in a closed position shown in FIG. 4.

Figure 4:
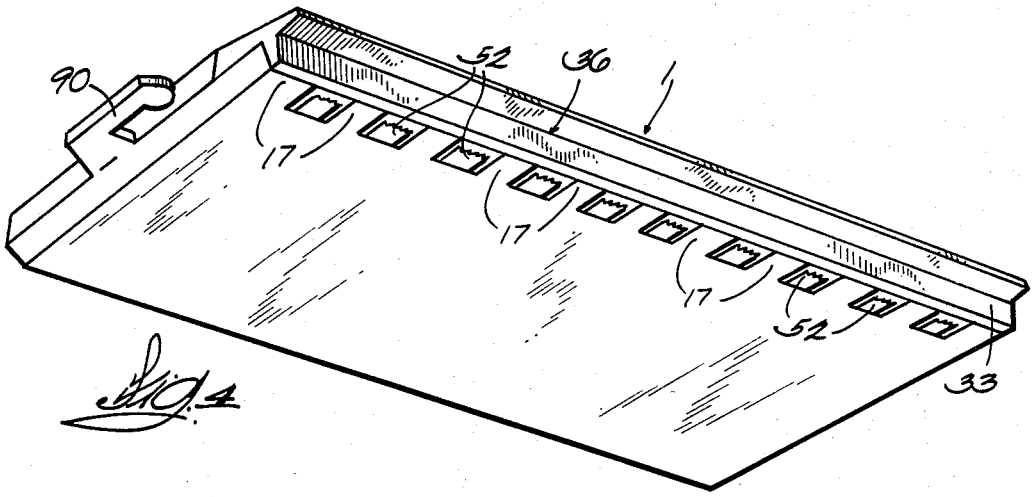
FIG. 4 is a perspective view of the dispenser of FIG. 1 in the closed condition, viewed from the underside of the dispenser.

FIG. 4 illustrates the dispenser 1 of the present invention in its fully closed condition, which is the manner in which a worker would carry the dispenser prior to withdrawing tape. It will be noted that the end of each guard finger 17 extends slightly beyond the cutting edge of the adjacent cutting fingers 52 and that the second cover member 4 covers the tape severance compartment 6 so as to completely enclose the cutter bar 50. These structural features of the dispenser 1 act as a safety measure so as to minimize the chance of injury to a worker which might be caused by the cutting fingers 52. Both the sides and the front of each cutting finger are covered by a guard finger 17 and the front wall 33 so as to reduce the risk of injury from the cutting fingers.

The dispenser 1 as described hereinabove and illustrated in the drawings can be conveniently molded as an integral unit from suitable plastic materials such as polyolefins, nylons, polycarbonates, etc. Polypropylene is an especially useful plastic inasmuch as the hinges 25 and 35 can be formed as thin strips of polypropylene to provide a "living hinge". The cutter bar 50 may be a metal element attached to the dispenser as described above, or attached by any other suitable means such as mechanical fasteners or adhesive, or it may be formed as a molded plastic element integral with the other dispenser elements. A useful feature of the dispenser 1 is clearly shown in the drawings. Because the rolls of tape 70 are carried in a horizontal position on the vertical hubs 60, the dispenser 1 can be made as a flat receptacle which can be conveniently carried by a worker in a shirt pocket, pants pocket, etc. This is considered an important advantage of the dispenser of the present invention, particularly in comparison to those prior art devices which can only be made in the form of a bulky cylindrical receptacle. For further ease of transport, a hook 90 may extend from one of the side walls of the dispenser, for hanging the dispenser from a pocket, belt loop or pant loop is so desired.

(b) Operational Description

The operation of the tape dispenser 1 will be described by reference to FIGS. 5, 6 and 7 which illustrate sequential steps involved in withdrawing a length of tape from a roll housed in the tape storage compartment 5 of the dispenser.

However, reference should first be made to FIG. 4 which is mentioned previously, illustrates the dispenser 1 with both the first and second cover members in their closed positions. The second cover member covers the tape dispensing compartment 6 and encloses the cutter bar 50 so as to reduce the likelihood of injury to a user. With the front wall 33 of the second cover member spaced inwardly of the side walls 31 and 32 as illustrated, the forward edge portion 36 of the second cover member forms a handle which can be easily grasped by a user to hinge the second cover member upwardly to its open position wherein the tape severance compartment 6 is exposed.

The open position of the second cover member is illustrated in FIG. 5. When in this position, the tape dispensing compartment 6 of the dispenser 1 is open to expose the flexible retention wings and the cutting fingers 52. Tape 70 from a roll thereof carried on a hub 60 extends across a flexible retention wing 40 and the user pulls the tape manually in the direction shown by arrow A in FIG. 5 until a length sufficient for the intended use has been withdrawn.

Next, turning now to FIG. 6, the user draws the tape 70 downwardly across a cutting finger 52 so as to sever the selected length of tape. During this downward movement of the tape 70, the flexible retention wing 40 flexes or bends downwardly as illustrated in this drawing.

Turning next to FIG. 7, after a length of tape 70 has been severed from a roll, the adhesive layer 71 of the remaining tape remains lightly adhered to a flexible retention wing 40. Upon completion of the severance action, the flexible retention wing 40 returns to its original position of FIG. 5 and the straightening action of a retention wing serves to remove the cut end of the tape 70 from the cutting edge of a cutting finger 52. This deflection and subsequent straightening of a flexible retention wing provides a positive force for lifting the end of the tape from a cutting edge in order to more certainly return it to the position shown in FIG. 7. When in the position of FIG. 7, the tape 70 has a free end portion 70*a* which extends beyond the end of the retention wing 40, and the adhesive layer 71 of the tape is lightly adhered to the retention wing. The free end portion 70*a* can be readily grasped by a user when it is next desired to withdraw another length of the tape and sever it for application to an object. Especially useful results are obtained when the architectural relationship between a cutting finger and a flexible retention wing is such that the free end portion 70A is about ⅛" to ¼" long; this provides an end portion long enough to grasp and yet not so long as to expose an undue length of the adhesive layer of the tape to dirt or the contamination.

After severing a length of tape as illustrated in FIGS. 5–7, and assuming no further tape is required for the moment, the user folds the second cover member 4 downwardly to its closed position shown in FIG. 4 to thereby cover the cutter bar 50 and also cover the exposed free ends of the tape on the various rolls stored in the dispenser.

Industrial Applicability

A tape dispenser constructed in accordance with the features of the present invention has a number of advantages over the known prior art devices which will enhance its industrial utility in numerous instances in which it is desired to use a length of pressure sensitive adhesive tape as an identification marker, or for any other purpose such as wrapping an article with tape.

The multiple roll tape dispenser described hereinabove includes a base member and two cover members arranged so as to form a dispenser having a tape storage compartment and a tape dispensing compartment. This feature enables a user to uncover only the tape dispensing compartment when it is desired to remove a length of tape from any of the rolls stored in the dispenser. During the dispensing action, the storage compartment of the dispenser remains closed so as to protect the remaining rolls of tape against contamination with dirt, etc., or from accidentally becoming dislodged from the dispenser. Moreover, after one or more rolls of tape in the storage compartment have been depleted and it is necessary to insert fresh replacement rolls, opening of the first cover member fully exposes the storage compartment of the dispenser so that it is easy and convenient to withdraw an old roll and insert a fresh roll. An added feature of this construction is that a user can immediately see the entire tape storage compartment when the cover is open and can therefore quickly check the tape supply.

Another important advantage of the structure of the present dispenser is the manner in which it incorporates cutting fingers spaced from or separated from flexible tape retention wings. Due to this separation of the cutting fingers and retention wings, a free end of a tape is formed after severance of the tape across a cutting finger which extends beyond a retention wing. This extending free end portion forms a tab which a user can conveniently grasp when it is desired to dispense the next length of tape from a roll. Also, the pressure sensitive adhesive layer of a tape is slightly adhered to a retention wing to hold each tape in this condition and yet allow for its easy withdrawal.

The flexible retention wings incorporated in the structure of the present tape dispenser represent still another important feature. During severance of the tape, a retention wing deflects as described above so that after a length of tape has been severed across a cutting finger, a retention wing returns to its original position and thereby acts to withdraw the adhesive layer of the tape from a cutting finger. This provides a positive release of a tape from a cutting finger and is an important aid in obtaining severance of the tape in such manner as to provide a free end portion of a tape extending beyond a retention wing.

A further important feature of the illustrated embodiment of the present tape dispenser is the manner in which the second cover member fully enclosed the tape dispensing compartment of the dispenser in which the cutting fingers are located. This provides a safety measure in that the cutting edges of the cutting fingers are not left exposed, which would be likely to cause injury to a user of the dispenser. In addition, the guard fingers located in the tape dispensing compartment are interdigitated with the cutting fingers and preferably the ends of the guard fingers extend slightly beyond the cutting edges of the cutting fingers so as to further enhance the safety of the dispenser.

As indicated above and illustrated in the drawings, the new tape dispenser of the present invention can be made in the form of a flat rectangular dispenser which is of a convenient shape and size for carrying in a pocket, purse, brief case, etc., as distinguished from the more bulky cylindrical multiple roll tape dispensers known in the art. As an example, a dispenser 1 was made that was about 6" long, 3" wide and ¾" high. It was found suitable for storage of 10 rolls of tape 3/16" wide on cores about 13/16"in diameter. The dispenser was compact, convenient to use and carry, and met all the objectives of this invention.

The tape dispenser of the present invention has been described in sufficient detail to fully teach the invention to those skilled in the art. Several changes to the illustrated embodiment have been described above, but other changes and modifications in the form and arrangement of the several parts of the tape dispenser may be made without departing from the principles of this invention and it should be understood that such changes as would be obvious to those skilled in the art upon examination of the present tape dispenser are intended to be encompassed within the scope of the appended claims.

I claim:

1. A dispenser for a plurality of rolls of tape of the type having a layer of pressure sensitive adhesive comprising, in combination:

(1) a base member including a divider wall separating the base member into a tape storage compartment and a tape dispensing compartment;

(2) a first cover member hinged to the base member and extending over the tape storage compartment when in a closed position;

(3) a second cover member hinged to the first cover member and extending over the tape dispensing compartment when in a closed position;

(4) the tape dispensing compartment including (a) a plurality of flexible retention wings extending from the divider wall, (b) a plurality of guard fingers spaced from the flexible retention wings, and (c) tape cutting means extending across the guard fingers and spaced from the flexible retention wings;

wherein tape from a roll in the tape storage compartment of the dispenser is manually severable by drawing across a flexible retention wing and against the tape cutting means, following which its pressure sensitive adhesive layer is lightly adhered to a flexible retention wing and the tape has a free end portion extending therebeyond to be grasped for subsequent severance of the tape.

2. A dispenser according to claim 1, in which: the second cover member includes wall panels arranged to enclose the tape cutting means when in its closed position.

3. A dispenser according to claim 1, in which:

(a) the second cover member includes a front wall arranged to enclose the tape cutting means when in its closed position; and (b) the tape cutting means includes cutting edge means positioned across the guard fingers, and the guard fingers have ends extending beyond the cutting edge means.

4. A dispenser for a plurality of rolls of tape of the type having a layer of pressure sensitive adhesive comprising, in combination:

(1) a base member including a divider wall separating the base member into a tape storage compartment and a tape dispensing compartment;

(2) a first cover member hinged to the base member and extending over the tape storage compartment when in a closed position;

(3) a second cover member hinged to the first cover member and extending over the tape dispensing compartment when in a closed position;

(4) the tape dispensing compartment including (a) a plurality of flexible retention wings extending from the divider wall, (b) a plurality of guard fingers spaced from the retention wings, and (c) tape cutting means having a plurality of spaced cutting fingers extending from the divider wall and interdigitated with the guard fingers;

wherein tape from a roll in the tape storage compartment of the dispenser is manually severable by drawing across a flexible retention wing and against a cutting finger, following which its pressure sensitive adhesive layer is lightly adhered to a flexible retention wing and the tape has a free end portion extending therebeyond to be grasped for subsequent severance of the tape.

5. A dispenser according to claim 4 in which:

(a) the base member includes a bottom panel, a rear wall and opposed side walls, and the divider wall extends between the side walls intermediate the ends thereof, the divider wall separating the bottom panel into a first portion positioned in the tape storage compartment and a second portion in the tape dispensing compartment;

(b) the first cover member is hinged to the rear wall of the base member;

(c) the flexible retention wings extend from an upper edge of the divider wall and the cutting fingers extend from a lower edge thereof; and (d) the second portion of the bottom panel of the base member includes a plurality of spaced slots which define the guard fingers.

6. A dispenser according to claim 4, in which:

(a) the second cover member includes a front wall arranged to enclose the tape cutting means; and (b) each guard finger has an end extending beyond ends of its adjacent cutting fingers.

7. A dispenser according to claim 4, 5 or 6 in which: the tape cutting means is arranged inside the tape dispensing compartment and the cutting fingers are fully enclosed when the second cover member is in its closed position.

8. A dispenser according to claim 4, 5 or 6 in which: the tape cutting means is an L-shaped member having a vertical leg positioned alongside the divider wall and cutting fingers extending therefrom, and the vertical leg of the tape cutting means has one edge inserted in notches formed between the flexible retention wings and the divider wall and an opposite edge inserted in notches formed across the guard fingers to thereby secure the tape cutting means in position.

* * * * *